US005422611A

United States Patent [19]

Kashima et al.

[11] Patent Number: 5,422,611

[45] Date of Patent: Jun. 6, 1995

[54] WAVEGUIDE-MICROSTRIPLINE TRANSFORMER

[75] Inventors: Yukiro Kashima, Takatsuki; Akira Kinoshita, Osaka; Yoshikazu Yoshimura, Takatsuki, all of Japan

[73] Assignee: Matsushita Electric Indust. Co., Ltd., Osaka, Japan

[21] Appl. No.: 155,654

[22] Filed: Nov. 22, 1993

[30] Foreign Application Priority Data

Nov. 26, 1992 [JP] Japan ..... 4-316806

[51] Int. Cl.[6] ..... H01P 5/107; H01P 5/12

[52] U.S. Cl. ..... 333/137; 333/26

[58] Field of Search ..... 333/21 R, 21 A, 26, 333/137; 343/859

[56] References Cited

U.S. PATENT DOCUMENTS

| | | | |
|---|---|---|---|
| 4,608,713 | 8/1986 | Shiomi et al. | 333/26 X |
| 4,868,639 | 9/1989 | Mugiya et al. | 333/26 X |
| 4,896,163 | 1/1990 | Shibata et al. | 333/21 A X |

FOREIGN PATENT DOCUMENTS

| | | | |
|---|---|---|---|
| 0295688 | 12/1988 | European Pat. Off. . | |
| 60-230701 | 11/1985 | Japan . | |
| 52001 | 3/1986 | Japan | 333/21 A |
| 61-141203 | 6/1986 | Japan . | |
| 63-171003 | 7/1988 | Japan . | |
| 4-109702 | 4/1992 | Japan . | |

OTHER PUBLICATIONS

K. Ogawa et al., "A 50 GHz GaAs FET MIC Transmitter/Receiver Using Hermetic Miniature Probe Transitions", vol. 37, No. 9, (Sep. 1989).

*Primary Examiner*—Paul Gensler

*Attorney, Agent, or Firm*—Willian Brinks Hofer Gilson & Lione

[57] ABSTRACT

A waveguide-microstripline transformer comprises a waveguide which is closed at one end and has a slit at a side wall thereof, a dielectric substrate plate placed on the slit, a microstripline placed on the dielectric substrate plate, and a shield case covering the dielectric substrate plate, whereby less blocking of the incident electromagnetic wave is attained.

13 Claims, 3 Drawing Sheets

WAVEGUIDE-MICROSTRIPLINE TRANSFORMER

BACKGROUND OF THE INVENTION

This invention relates to a waveguide-microstripline transformer, which is used in a down converter etc. for broadcasting or communication by man-made satellites, and more particularly to a waveguide-microstripline transformer in which the mode of the electromagnetic wave is transformed from a mode for propagating in a waveguide to a mode for propagating in a microstripline.

In recent years, commercial satellite (CS) broadcasting has become popular, and CS broadcasts which use commercial communication satellites are now being implemented. This has resulted in increased occasions for general households to receive broadcasts from plural satellites. In the course of this development, in addition to the demands for reduced size and lower costs for the receiving antenna, a new problem has arisen due to the interference of a polarized wave from one satellite with a differently polarized wave from another satellite. As such, there is a renewed interest in the importance of a low-noise down-converter having excellent performance, which has the ability to discriminate cross-polarization waves in order to determine when a parabola antenna is used, regardless of whether there is suppression of the interference.

What follows is an explanation of a conventional waveguide-microstripline transformer, as shown in FIGS. 3(*a*)–3(*d*). A conventional waveguide-microstripline transformer comprises a cylindrical waveguide 1, a shield case 2, dielectric substrate plate 3, and two microstriplines 4 and 5 working as probes. The shield case 2 or a short cylinder with a bottom plate has an inside diameter the same as the waveguide 1, a depth equal to $\frac{1}{4}$ of the wave length and closes the end of the waveguide 1 with a dielectric substrate plate 3 in between. On the dielectric substrate plate 3, there are microstriplines 4 and 5 working as probes.

When an electromagnetic wave (assuming the wave is single polarized) is propagated through the waveguide 1, it is totally reflected by the shield case 2, and the reflected wave excites the microstripline probe 4 so as to be transformed to an electromagnetic wave which propagates along the microstripline. If the incident electromagnetic waves are of cross-polarized type, providing another microstripline probe 5 makes it possible to transform two mutually orthogonal polarized waves into waves propagating on the microstriplines.

However, in the above conventional structure it is necessary to make the waveguide 1 and the dielectric substrate plate 3 perpendicular to each other. This proves problematic when used in combination with a parabolic reflector such as an antenna, because there will be an undesirably large area that can block the electromagnetic wave incident upon the reflector. This conventional structure also is inferior when receiving cross-polarized waves, as the orthogonally polarized waves either interfere with each other or the structure's ability to discriminate between them decreases, because the two microstripline probes 4 and 5 must be formed on the same dielectric substrate plate 3 intersecting the waveguide 1.

There thus exists a need in the art for a waveguide-microstripline transformer that reduces the possibility of the electromagnetic waves being blocked before reaching the reflector. Further, there is a need for a waveguide-microstripline transformer that will effectively separate and discriminate between two incident orthogonally polarized waves.

SUMMARY OF THE INVENTION

It is therefore an object of the present invention to provide a waveguide-microstripline transformer that will result in less electromagnetic wave blocking.

It is another object of the present invention to provide a waveguide-microstripline transformer that can achieve excellent discrimination of cross-polarized waves.

To attain the above-described objects, the waveguide-microstripline transformer for receiving single polarized waves according to the present invention comprises a waveguide having a slit at a side wall thereof, a dielectric substrate plate placed on the slit, a microstripline working as a probe on the dielectric substrate plate, and a shield case covering the dielectric substrate plate. According to this configuration, electromagnetic waves incident upon the waveguide are transformed by passing through the slit into a mode for propagating through the waveguide, and are further transformed, due to being stopped and reflected by the shield case, into a mode for propagating along the microstripline.

According to the present invention, with the probe being placed on the side wall of the waveguide, undesirable blocking is reduced considerably, and the electromagnetic wave, after passing through the slit, is reflected at the end of the shield case so as to be efficiently transformed into a wave propagating along the microstripline.

In this embodiment, if the waveguide has an inner circular cross-section, the electromagnetic wave may be efficiently transformed to the shield case by arranging the longitudinal direction of the slit parallel to the Z-axis of the waveguide.

According to further details of the present invention, the dielectric substrate plate is provided, in addition to the above-described microstripline probe, with an earthing conductor on the underside thereof, connected with the waveguide and the shield case, thereby ensuring that the electromagnetic wave propagates from the waveguide to the shield case without suffering wave leakage.

Further, by using a rectangular form for the shield case, the probability of total reflection of the electromagnetic wave under rectangular-waveguide propagation mode by the end of the shield case is greatly increased.

In order to receive cross-polarized waves, the waveguide-microstripline transformer according to a second embodiment of the present invention is further provided with a conductive bar piercing through a hole in a side wall of the waveguide, having a dielectric ring placed there between. A metal plate is also provided in the waveguide between the probe and the conductive bar, being connected to a second microstripline also formed on the dielectric substrate plate, the metal plate being parallel to a line passing through the probe and the conductive bar. According to this structure, waves consisting of two orthogonally polarized waves are separated by the metal plate, and each polarized wave individually excites the microstripline and the conductive bar, thereby resulting in reliable separation and favorable discrimination of cross-polarized waves.

The present invention, including all attendant features and advantages, is best understood by reference to the following detailed description of the invention, taken in conjunction with the accompanying drawings.

BRIEF DESCRIPTION OF THE DRAWINGS

FIG. 2(*b*) is a side section of the waveguide-microstripline transformer showing the second embodiment of the present invention.

FIG. 3(*b*) is a side section of the conventional waveguide-microstripline transformer for receiving single-polarized waves. FIG. 3(*c*) is a plan view of another conventional waveguide-microstripline transformer for receiving cross-polarized waves. FIG. 3(*d*) is a side section of the conventional waveguide-microstripline transformer for receiving cross-polarized waves.

DETAILED DESCRIPTION OF THE INVENTION

First Embodiment

Figure 1A:
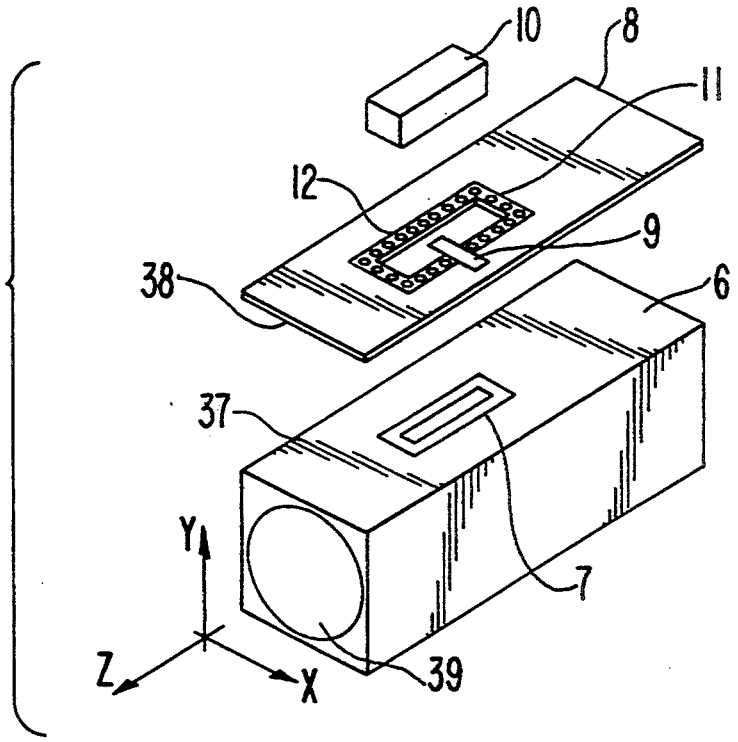
Fig. 1(a) is an exploded perspective view of a waveguide-microstripline transformer showing the first embodiment of the present invention.
Figure 1B:
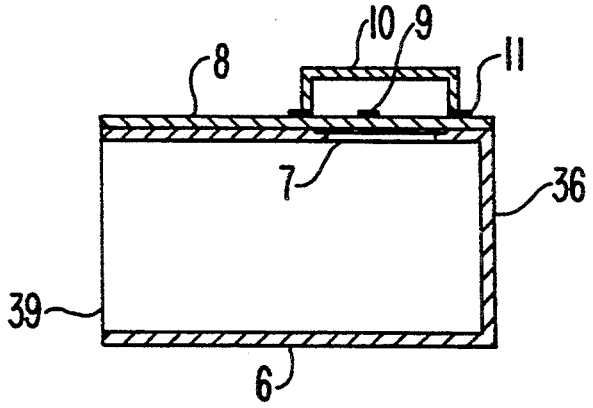
FIG. 1(*b*) is a side section of the waveguide-microstripline transformer showing the first embodiment of the present invention.

Referring now to the drawings, FIGS. 1(*a*)–1(*b*) show a waveguide-microstripline transformer according to the present invention which comprises a cylindrical waveguide 6 having an inner circular cross-section and a metal wall 36 at one end. A rectangular slit 7 is located at a side wall 37 of the waveguide 6. Provided on the side wall 37 is a dielectric substrate plate 8, on which a microstripline 9 functioning as a probe is placed. The dielectric substrate plate 8 is partially covered with a shield case 10 soldered to the dielectric substrate plate 8 by way of copper foil 11, and is further provided with an earth conductor 38 on the surface opposite to the shield case 10. The shield case 10 and copper foil 11 are connected with the earth conductor 38 through holes 12 located on the copper foil 11.

When an electromagnetic wave (not shown) arrives through the opening 39 of the waveguide 6, it is totally reflected by the metal wall 36 at the end of the waveguide 6, and is transformed by the slit 7 from a mode for propagating in a circular waveguide to a mode for propagating in a rectangular waveguide, the rectangular waveguide being formed by the shield case 10 and a part of the outer surface of the side wall 37 of the cylindrical waveguide 6. Once the wave has been totally reflected by the metal wall 36, it excites the microstripline probe 9, and is transformed to a wave for propagating along the microstripline probe 9. For waves ranging from 11 GHz to 12 GHz, the best results were achieved when the slit 7 had 1 mm depth, 15 mm length (along the Z-axis), and 2 to 3 mm width, while the shield case 10 acting as a rectangular waveguide had an opening with dimensions of 20 mm×(5 to 6) mm and a depth of 5 mm. Further, part of the outer surface of the side wall 37 is shaped in a rectangular form to conform to the shield case 10, as shown in FIG. 1(*a*). Accordingly, an appropriate depth of the wall for achieving impedance matching is achieved.

According to the waveguide-microstripline transformer of the present embodiment, very favorable wave transformation was attained without requiring the waveguide 6 and the dielectric substrate plate 8 to be perpendicular to each other. Further, when used in combination with a reflector of parabolic form, undesirable wave blocking is considerably reduced. The earth conductor 38 and waveguide 6 are in contact with each other, therefore ensuring they are kept at the same electric potential. Further, because the shield case 10 is connected with the earth conductor 38 through the holes 12, the shield case 10 and earth conductor 38 will maintain the same electric potential at high frequencies. As such, the electromagnetic wave will propagate from the waveguide 6 to the shield case 10 without experiencing wave leakage.

Second Embodiment

Figure 2A:
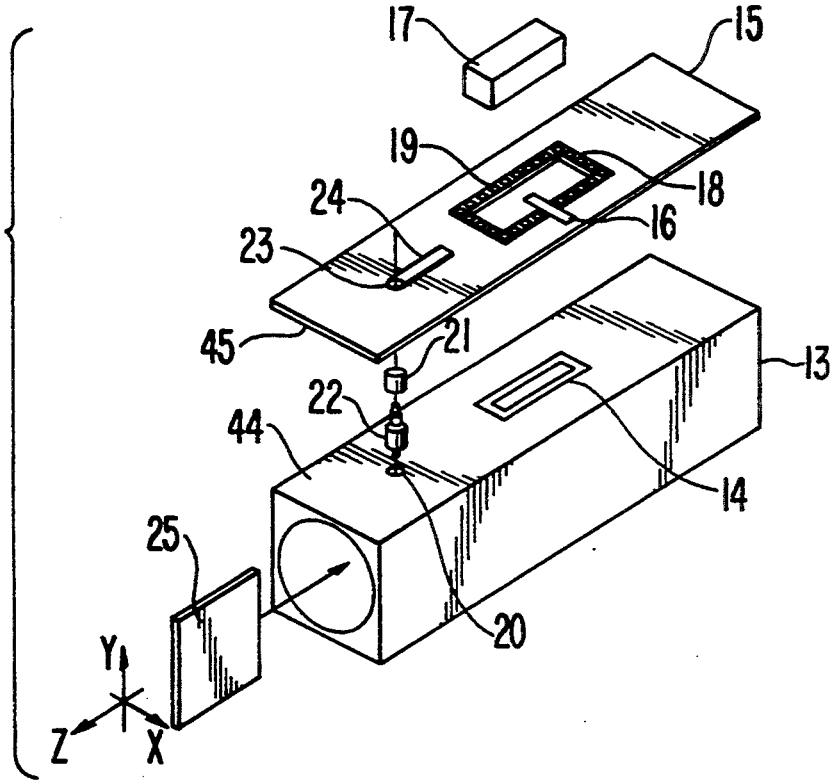
FIG. 2(*a*) is an exploded perspective view of a waveguide-microstripline transformer showing the second embodiment of the present invention.
Figure 2B:
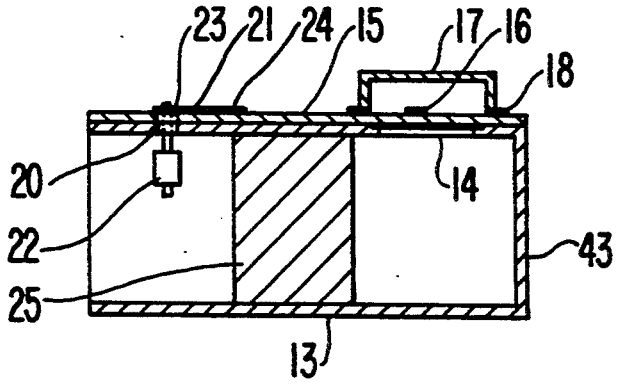
Figure 3A:
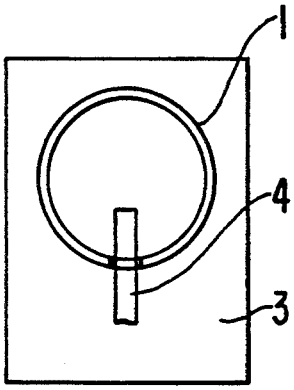
FIG. 3(a) (PRIOR ART)
FIG. 3(*a*) is a plan view of a conventional waveguide-microstripline transformer for receiving single-polarized waves.
Figure 3B:
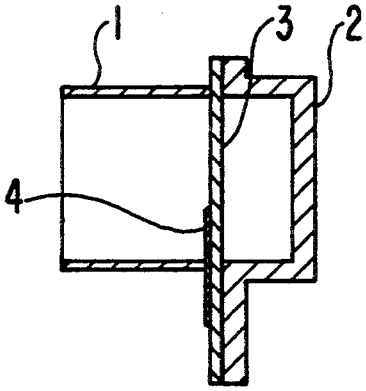
FIG. 3(b) (PRIOR ART)
Figure 3C:
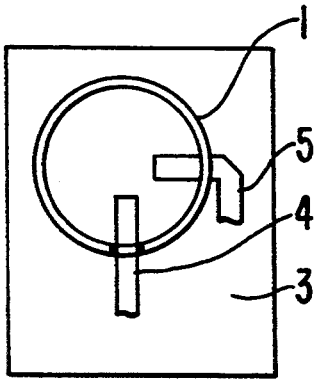
FIG. 3(c) (PRIOR ART)
Figure 3D:
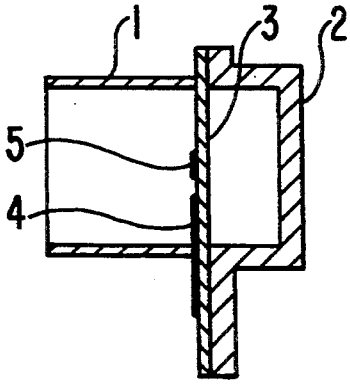
FIG. 3(d) (PRIOR ART)

Referring now to FIGS. 2(*a*)–2(*b*), a second waveguide-microstripline transformer according to the present invention is shown, which comprises a cylindrical waveguide 13 closed at the end with a metal wall 43 and has a rectangular slit 14 at a side wall 44 thereof. Provided on the side wall 44 is a dielectric substrate plate 15 on which a first microstripline 16 functioning as a probe is placed. The dielectric substrate plate 15 is covered with a shield case 17 soldered to the dielectric substrate plate 15 by way of copper foil 18. The shield case 17 and the copper foil 18 are connected electrically with an earth conductor 45 located on the underside of the dielectric substrate plate 15 through holes 19 in the copper foil 18.

In this embodiment, the waveguide 13 is further provided with an electrical conductive bar 22 and a metal plate 25. The conductive bar 22 is inserted into the waveguide 13 to a certain length (one-quarter of the input of the signal wavelength in general) through a hole 20 and is supported by an insulator ring 21 in between the hole 20. The conductive bar 22 is soldered to a second microstripline probe 24 deposited on the dielectric substrate plate 15 at a hole 23 in the second microstripline probe 24. The metal plate 25 is placed between the first microstripline probe 16 and the conductive bar 22 within the waveguide 13, the main surface of the metal plate 25 being parallel to the indicated Y-axis direction.

The length of insertion of the conductive bar 22 is dependent on the wavelength of the incoming electromagnetic wave. To conduct the electromagnetic wave effectively, the length of insertion should be about one-quarter (in mm) of the wavelength of the electromagnetic wave. Thus, if the frequency of the incoming wave is of the order of 11.70–12.75 GHz, the conductive bar 22 will be inserted into the waveguide 13 to a depth of about 6–7 mm.

When electromagnetic waves (not shown) consisting of two polarized waves—a wave with an electric field component of X-axis direction (EX), and a wave with an electric field component of Y-axis direction (EY)—enter the waveguide 13, the EY component is totally reflected by the metal plate 25, excites the conductive bar 22, and is transformed to an electromagnetic wave which propagates along the second microstripline probe 24, while the EX component passes through the waveguide 13 without being reflected by the metal plate 25, and is instead totally reflected by the metal wall 43 at the end of the wave guide 13, thereby being transformed into an electromagnetic wave which propagates along the first microstripline probe 16, in accordance with the above-described first embodiment.

Thus, according to this second embodiment, a waveguide-microstripline transformer is achieved which considerably reduces wave blocking as in the First Embodiment, and further maintains excellent separation and discrimination of two orthogonally polarized waves by exciting the first microstripline probe 16 and the conductor bar 22 at different places in the waveguide 13, separating the cross-polarized electromagnetic wave by use of the metal plate 25.

Variations of the above-described embodiments are possible. In the first embodiment, the shield case 10 can be fastened to the dielectric substrate plate 8 by a screw instead of soldering. Also, the shield case 10 may be formed as one body with the side wall 37 of the waveguide 6 proper, and a metal end plate may be fastened thereupon by a screw or other connecting means. This structure may of course be applied to the waveguide-microstripline transformer of the Second Embodiment.

Further, it should be understood that the cross-section of the inside wall of the waveguide 6 is not confined to circular form. It may be elliptic, polygonal or of any other form.

According to the present invention, a novel waveguide-microstripline transformer is obtained, whereby the dielectric substrate plate may be implemented parallel to the incoming direction of the electromagnetic wave, thereby considerably reducing the wave blocking effect which hinders effective operation of prior art transformers.

Further, the waveguide-microstripline transformer of the present invention is capable of receiving cross-polarized waves with excellent discrimination, by successfully maintaining separation of the orthogonally polarized waves.

The present invention may be embodied in other specific formats without departing from the spirit or essential characteristics thereof. The present embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. A waveguide-microstripline transformer comprising:

a waveguide closed at one end having a slit at a sidewall thereof;

a dielectric substrate plate placed on the outside surface of the sidewall and over the slit, the dielectric substrate plate being parallel to an axis of the waveguide;

a microstripline placed on the dielectric substrate plate, the dielectric substrate plate having on a surface opposite to the microstripline an earth conductor connected with the waveguide, the dielectric substrate plate having a conductive foil on the same surface as the microstripline, the conductive foil being electrically connected with the earth conductor through a hole in the dielectric substrate plate; and a shield case over the dielectric substrate plate and at least a part of the microstripline.

2. A waveguide-microstripline transformer comprising:

a waveguide closed at one end having a slit at a side wall thereof;

a dielectric substrate plate placed on the outside surface of the sidewall and over the slit;

a first microstripline placed on the dielectric substrate plate;

a shield case over the dielectric substrate plate;

a conductive bar penetrating a side wall of the waveguide through a hole, said conductive bar being supported by a dielectric ring surrounding the conductive bar;

a second microstripline connected with the conductive bar; and a metal plate within the waveguide between the first microstripline and the conductive bar, parallel with the conductive bar.

3. The waveguide-microstripline transformer of claim 2, the hole being in the same side wall as the side wall having the slit.

4. The waveguide-microstripline transformer of claim 2, the metal plate being parallel with a line passing through the conductor bar and the slit.

5. The waveguide-microstripline transformer of claim 2, the waveguide having an inner circular cross-section, and the slit being parallel to the waveguide axis.

6. The waveguide-microstripline transformer of claim 2, the dielectric substrate plate having on a surface opposite to the first microstripline an earth conductor connected with the waveguide.

7. The waveguide-microstripline transformer of claim 6, the dielectric substrate plate having a conductive foil on the same surface as the first microstripline, the conductive foil being electrically connected with the earth conductor through a hole in the dielectric substrate plate.

8. The waveguide-microstripline transformer of claim 2, the shield case having a rectangular cross-section.

9. The waveguide-microstripline transformer of claim 2, the dielectric substrate plate being parallel with the waveguide axis.

10. The waveguide-microstripline transformer of claim 2, the waveguide having an inner polygonal cross-section.

11. The waveguide-microstripline transformer of claim 2, the waveguide having an inner elliptical cross-section.

12. A waveguide-microstripline transformer comprising:

a waveguide closed at one end having a slit at a side wall thereof;

a dielectric substrate plate having on its underside an earth conductor connected with the waveguide placed on the outside surface of the side wall and over the slit;

a microstripline placed on the top side of the dielectric substrate plate; and a shield case over the top side of the dielectric substrate plate, wherein the dielectric substrate plate has a conductive foil on the same surface as the microstripline, the conductive foil being electrically connected with the earth conductor through a hole in the dielectric substrate plate.

13. The waveguide-microstripline transformer of claim 12, the shield case having a rectangular cross-section.

* * * * *